US005522341A

United States Patent [19]

Green

[11] Patent Number: 5,522,341

[45] Date of Patent: Jun. 4, 1996

[54] APPARATUS TO RAISE A SMALL BOAT

[75] Inventor: Tom Green, Delta, Canada

[73] Assignee: Sea Wise Marine Inc., Delta, Canada

[21] Appl. No.: 406,028

[22] Filed: Mar. 17, 1995

[51] Int. Cl.[6] ..... B63B 23/00

[52] U.S. Cl. ..... 114/365; 114/259

[58] Field of Search ..... 114/44, 259, 365, 114/366, 368, 369, 373; 414/546, 729

[56] References Cited

U.S. PATENT DOCUMENTS

| | | | |
|---|---|---|---|
| 3,143,991 | 8/1964 | Anderson . | |
| 3,216,388 | 11/1965 | Smith | 114/365 |
| 4,157,596 | 6/1979 | Green . | |
| 5,133,275 | 7/1992 | Maurizio | 114/365 |

*Primary Examiner*—Stephen Avila
*Attorney, Agent, or Firm*—Fulwider Patton Lee & Utecht

[57] ABSTRACT

Apparatus to raise a small boat and outboard motor from a position in the water to a stored position against the mother vessel with the outboard motor substantially vertical while in the storage position. The apparatus has a hinge mount that can be received on the small boat. There is a unitary mount for the outboard motor hinged to the hinge mount. A releasable lock attaches the unitary mount on the small boat to prevent hinging of the mount. There is a connector on the unitary mount remote from the hinge. A lift on the mother vessel is able to attach the connector on the unitary mount. There are abutments on the mother vessel and corresponding abutments on the small boat. These two abutments are able to engage each other to form a hinge about which the small boat can be pivoted during lifting by the lift.

9 Claims, 4 Drawing Sheets

FIG. 1
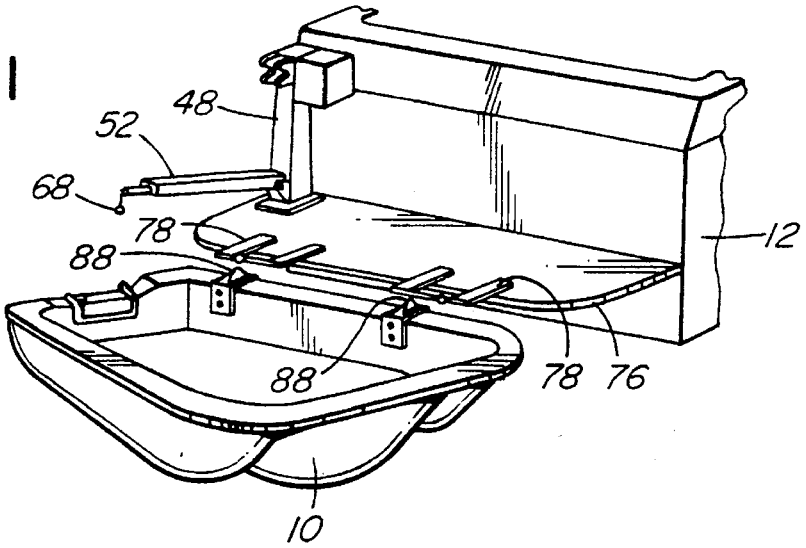
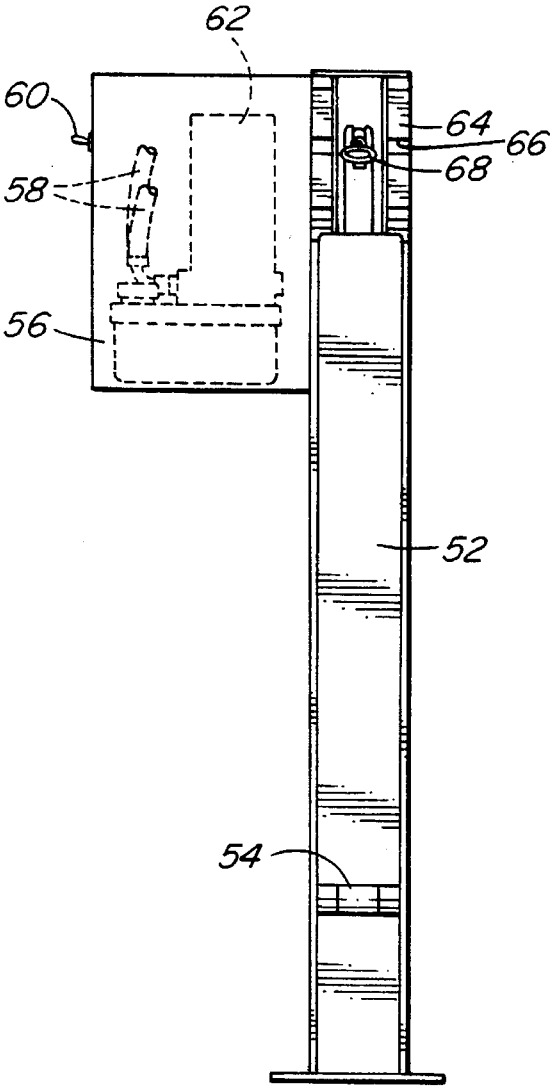
FIG. 2
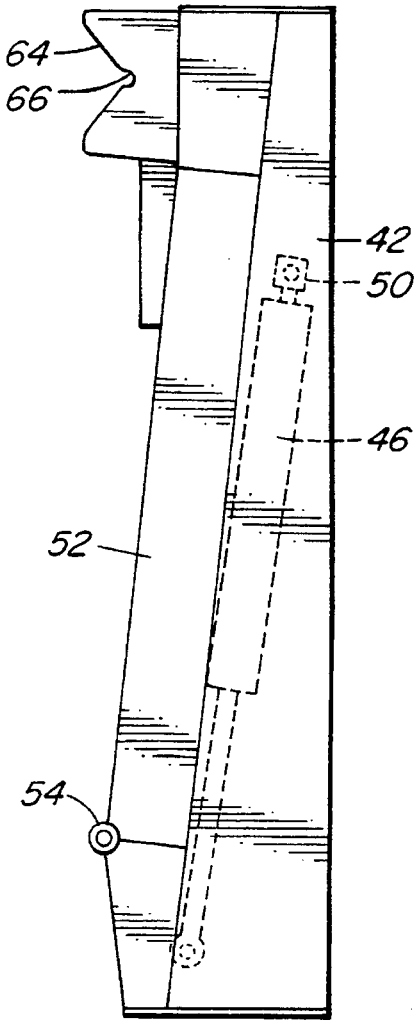
FIG. 3

APPARATUS TO RAISE A SMALL BOAT

FIELD OF THE INVENTION

This invention relations to an apparatus to raise a small boat with an outboard motor from a position where the small boat is floating in the water to a storage position on a mother vessel.

DESCRIPTION OF THE PRIOR ART

With large pleasure craft, particular motor driven pleasure craft, it is common to have a small boat or dinghy attached. The small boat is used for going ashore when the mother vessel is at anchor. Although for short journeys it is fairly common to tow the small boat behind the mother vessel, it is far more common, particularly with larger vessels, to store the small boat in a storage position against the stern of the mother vessel. U.S. Pat. No. 3,143,991 to Anderson describes and claims a mechanism for raising a small boat from a position floating astern the mother craft to a storage position against the stern of a mother craft. The mechanism in Anderson comprises articulated arms and hinged connections whereby the small boat may be lifted upwards and rotated through 90° to the storage position.

It is now common for small dinghies attached to mother vessels to carry an outboard motor. The mechanism disclosed by Anderson makes no provisions for the outboard motor. It is awkward and even unsafe to attempt to remove the outboard motor from the small boat at sea. Furthermore the lifting of the outboard motor to a suitable position for storing while the small boat is floating can be dangerous. There is also the possibility that the motor can be dropped which, at sea, obviously means the loss of the outboard motor.

U.S. Pat. No. 4,157,596 to Green issued Jun. 12, 1979 describes and claims an apparatus for moving an outboard motor between a storage position adjacent a mother vessel and an operational position on a small boat floating generally adjacent the mother vessel. The apparatus of Green comprises a mount for the outboard motor connectable to the small boat, a lifting arm connectable to the mother vessel at one end and connectable to the mount at a second end. There is a mechanism for lifting the lifting arm from a lowered position to a raised position and for lifting the mount from the operational position to the storage position when the mount is connected to the lifting arm.

The invention of Green has the great advantage of being able to lift a small boat and an outboard motor and arranging for the storage of the outboard motor without the risk of loss of the motor.

However, there are disadvantages to the structure in Green. It is fairly complicated. It is sophisticated and expensive to make and the number of pivotal or hinged joints in the structure to Green are a disadvantage, bearing in mind the adverse conditions under which these boat lifting devices often have to be used.

The present invention is therefore an improvement in the invention of Green and seeks to simplify both the use and the manufacturing of the apparatus as described and claimed in the above U.S. Pat. No. 4,157,596.

SUMMARY OF THE INVENTION

Accordingly, and in a first aspect, the present invention is an apparatus to raise a small boat and outboard motor from a position in the water to a storage position against a mother vessel with the outboard motor substantially vertical while in the storage position, the apparatus comprising a hinge mount adapted to be received on said small boat; a unitary mount for the outboard motor hinged to said hinge mount; releasable means to lock the unitary mount on the small boat to prevent hinging of the mount; connection means on the unitary mount, remote from the hinge; lifting means on the mother vessel able to attach to said connection means on said unitary mount; first abutment means on said mother vessel; second abutment means on said small boat; the first and second abutment means being able to engage each other to form a hinge about which the small boat can be pivoted during lifting by the lifting means.

DESCRIPTION OF THE DRAWINGS

The invention is illustrated, by way of example, in the drawings in which:

FIG. 1 is a general view of a preferred embodiment of the present invention;

FIG. 2 is a detail of the lift of FIG. 1;

FIG. 3 is a side elevation of FIG. 2;

DESCRIPTION OF THE PREFERRED EMBODIMENTS

The drawings show an apparatus to move a small boat 10 having an outboard motor (not shown) from a position in the water, as shown in FIG. 1, to a storage position against the stern of a mother vessel 12 with the outboard motor substantially vertical while the small boat 10 is in the storage position.

Figure 4:
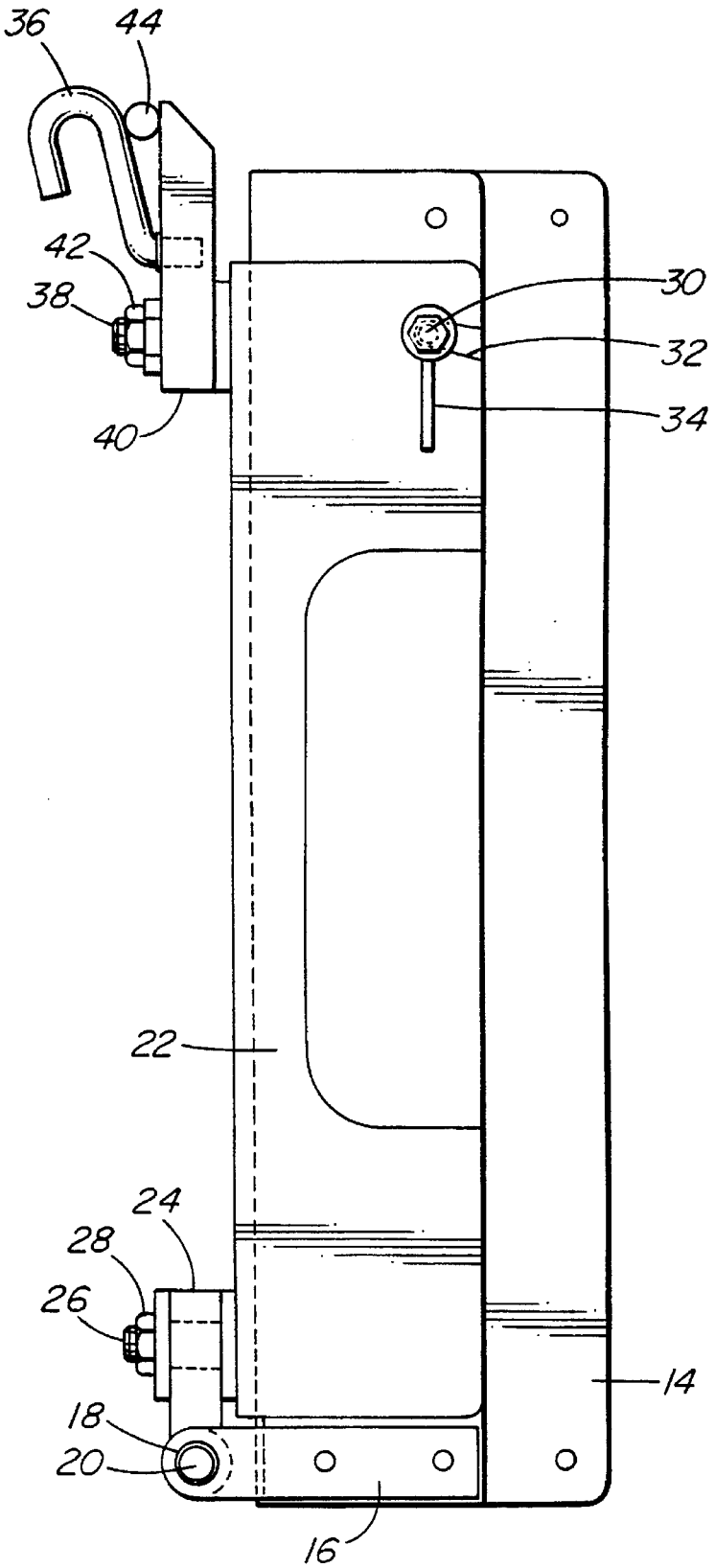
FIG. 4 is a side elevation of the hinge-mounted unitary mount for the outboard motor.
Figure 5:
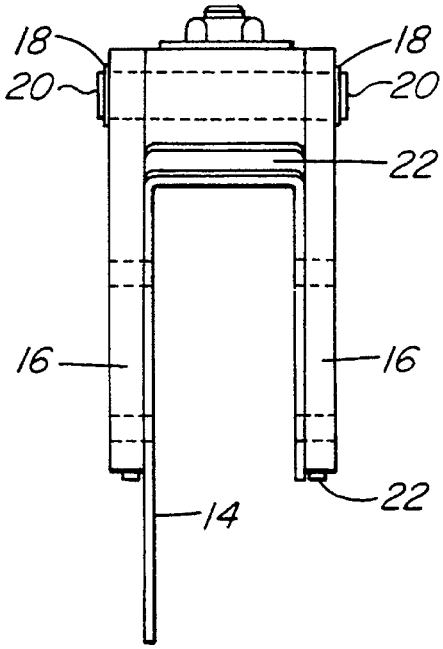
FIG. 5 is a side elevation of FIG. 4.

The apparatus has a hinge mount for the outboard motor that can be received on the small boat 10. As shown particularly in FIGS. 4 and 5, the hinge mount comprises a first U-section bracket 14 that is attached to the small boat 10, for example by bolts. There are posts 16 on the first bracket 14 that may be welded or, as shown in FIG. 4, bolted to the first bracket 14. The posts 16 are provided with aligned openings 18 that receive a hinge pin 20 held in position by a circlip. There is a unitary mount for the outboard motor that is hinged to the posts 16 by the hinge pin 20. The unitary mount is shown in FIG. 4 and 5 to comprise a second U-section bracket 22 that fits over the first U-section bracket 14 and has a pivot arm 24 attached to it by a stud 26 that receives a nut 28. The pivot arm 24 has a boss having an opening alignable with the openings 18 so that the hinge pin 20 fits through the three openings to provide a hinge joint.

There are releasable means to lock the unitary mount 22 on the small boat 10 to prevent hinging of the mount 22 when the small boat is in the water and the outboard motor attached and, in particular, running. In the illustrated embodiment, the releasable means comprises a stud 30 received on the first bracket 14. There is a recess 32 in the second bracket 22 that fits over the stud 30. A wing nut 34 can be fastened on the stud 30 to attach the first and second brackets together, preventing relative movement of the first and second brackets 14 and 22 when the nut 34 is tightened.

The unitary mount 22 is provided with connection means in the form of a hook 36 mounted on the second bracket 22 remote from the hinge 20. A second stud 38 is provided on the second bracket 22 to receive an arm 40 which is located on the stud 38 by nut 42. Hook 36 is then welded to the arm 40. A rod 44 is inserted to provide reinforcement of the hook 36 and to help anchor the stored boat 10.

Figure 9:
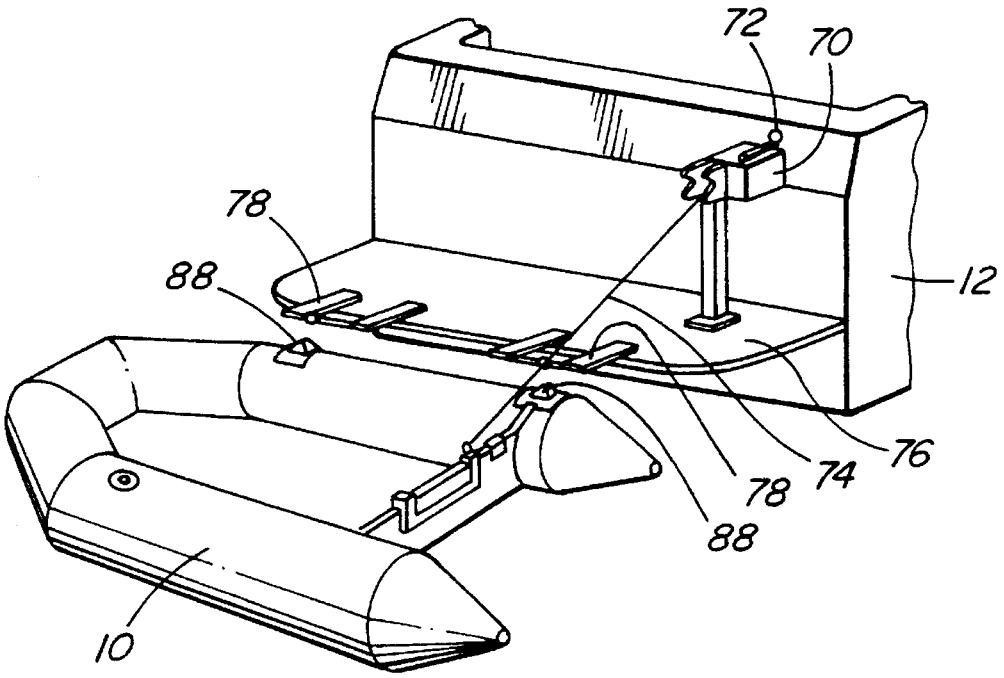
FIG. 9 shows a variation of the embodiment of FIG. 1.

There are lifting means on the mother vessel 12 able to attach to the hook 36 on the unitary mount 22. The lifting means may be hydraulic lift, as shown in FIG. 1, or may be a mechanically operated lift, as shown in FIG. 9. FIGS. 2 and 3 show the lift to comprise a hydraulic cylinder 46 received within housing 48 and anchored within the housing at 50 and pivotally attached to an arm 52 which pivots about pivot pin 54. There is a lift rod having an eye attached to it. FIG. 2 shows schematically a hydraulic power unit 56 with hoses 58 attached to it which extend to the cylinder 46 in conventional manner. The cylinder 46 is double acting. There is a switch 60 to provide electric power to a hydraulic motor 62. The lifting unit is provided with recesses 64 having an arcuate inner end 66 to receive rod 44. An eye 68 fits over the hook 36 shown in FIG. 4.

A variation of this arrangement is shown in FIG. 9. There the lifting means is a simple gear-box 70 operable by a handle 72 from aboard the mother vessel 12. No details of the box are shown. There is a wheel inside that receives a cable 74. The end of the cable 74 has an eye 68 on it, as shown in FIGS. 1 and 2 for the hydraulic lifting embodiment, that again is received on the hook 36. Typically the gear box 70 will have a gear ratio of about 25 to 1 but that is a matter of choice.

Figure 6:
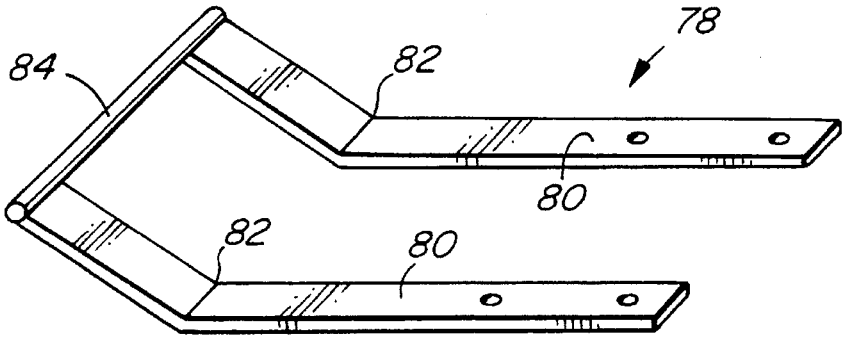
FIG. 6 is a detail of a bracket shown in FIG. 1.
Figure 7:
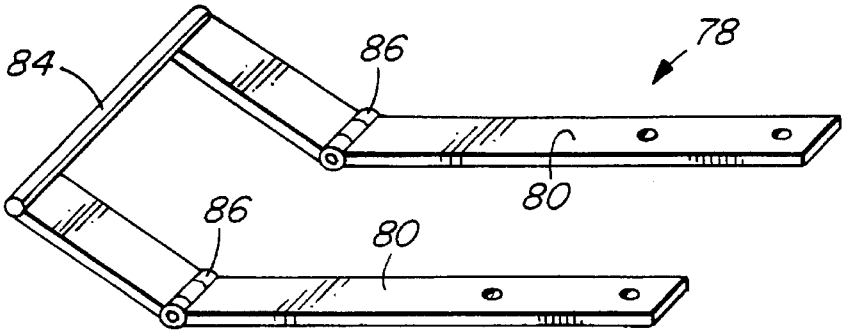
FIG. 7 is variation of the bracket of FIG. 6.

The illustrated mother vessel 12 is equipped with a swimming board 76 and the swimming board has attached to it simple brackets 78 as shown in FIG. 6 or in a variation, FIG. 7. Two brackets 78 are bolted to the swimming board 76. The bracket comprises simple flat bars 80, angled upwardly at 82 with a connecting rod 84 at their outer ends. In the variation of FIG. 7, there are hinged joints 86 in which the hinge members have serrated inner abutting ends. A bolt extends through the hinge members to lock them in a pre-selected position. The embodiment of FIG. 7 thus allows control of the height of the rods 84 but otherwise functions precisely as for the embodiment of FIG. 6. On the gunwale of the boat 10 there are simple abutment brackets 88 as shown particularly in FIGS. 1 and 9. These bracket simply comprise a solid body having an arcuate recess that is a fairly close fit on the rods 84 of brackets 78.

The apparatus is simple to use. The outboard motor is mounted on the unitary mount 22 for the outboard motor in conventional manner. Typically there are wing nuts provided on the outboard motor and U-clamps that can be gripped to the rear bulk head of a small vessel. For the present invention these U-clamps are tightened on the second bracket 22 and, at least as far as the apparatus of the present invention is concerned, there is no need to disturb these U-clamps.

Similarly the hydraulic lift of FIGS. 2 and 3 is in the position shown in FIG. 3 most of the time and, in particular, will be in that position when the small boat is in use.

To store the boat 10, it is brought to the stern of the mother vessel 12, to the position shown in FIGS. 1 and 9. FIG. 1 illustrates that the lift may be on the port side of the vessel 12 and FIG. 9 shows the starboard side. It is immaterial to the present invention. When the small boat 10 is brought to the stern, the abutments 88 are brought into contact with the rods 84 on the brackets 78. The lift is operated so that the arm 52 moves downwardly as shown in FIG. 1. The wing nut 34 which is tightened while the motor is in use, is loosened and the eye 68 engaged on the hook 36 which is on that end of the unitary mount 22 closer to the stern of the mother vessel 12. The switch 60 is operated to raise the arm 52 of the hydraulic lift in conventional manner. The small boat 10 pivots through 90° about the rods 84. Simultaneously the mount 22 pivots about the hinge pin 20 so that, in general, the motor remains vertical, still attached to the unitary mount 22 which remains pivotally attached to the boat 10.

When the boat has been turned through approximately 90° the rod 44 engages the recesses 66 and the boat 10 is firmly secured. Additional securing can be used as desired.

Launching the boat 10 is equally simple. From the stored position it is only necessary to lower the hydraulic lift so the boat 10 starts to move through 90°. At the same time the second bracket 22, with the motor attached, moves towards it useful position, that is to say it fits over the first bracket 14. The movement is completed to the position shown in FIG. 1. At that stage the eye 68 is disengaged from the hook 36. The wing nut 34 is tightened and the small boat 10 is ready for use once the outboard motor has been started. The release from the brackets 78 is automatic when the boat reaches the water As shown in FIG. 1 the invention is useful with fibreglass or wooden boats 10 or, as shown in FIG. 9, with inflatable dinghies.

Figure 8:
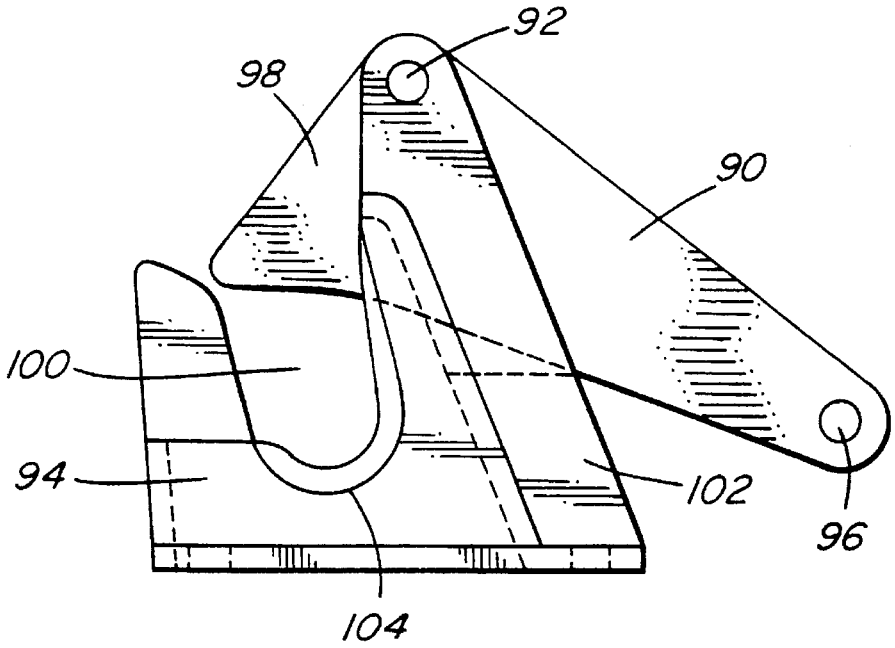
FIG. 8 is a preferred embodiment of a bracket to be installed on the gunwale of the small boat.

FIG. 8 illustrates a preferred embodiment of the abutments 88 to be mounted on the gunwale of the boat 10. There is a swing arm 90 pivotally attached at 92 to a base 94 and having a handle 96. This embodiment ensures the security of the boat 10 on the rods 84. When a load is applied on the outer surface of the inner end 98 of the swing arm 90, the arm moves downwardly, allowing a rod 84 to enter recess 100. However, once entered any load applied upwardly on the inner end of the swing arm 90 merely forces the arm 90 against an abutment 102, thus securing the swing arm 90. As shown in FIGS. 8 and 9 a protective insert 104 can be provided.

In general all components are made of stainless steel, bearing in mind the corrosive environment in which the apparatus is to be used.

Compared with the prior art, the apparatus of the present invention has a number of advantages. It is simple to make and easy to use. No mechanical adeptness is required in its use. The apparatus can be adapted to virtually all makes, models and types of mother-vessels and dinghies. There is excellent safety of operation. The hands are virtually kept free. There is no need to engage or disengage various components by hand. It is safe to step into a dingy while the dingy is in the water. The arrangement of the rods 84 and the abutments 88 on the boat 10 is such that they can connect automatically and disconnect, largely depending on the relative positions of the boat 10 and the swimming board 76. That is, as the boat 10 is lowered, it automatically disengages from abutments 88 and as the boat 10 is brought into position to be loaded aboard the mother-vessel the rods 84 will automatically engage the abutments 88. Similarly the hook 36 and the eye 68 of the lift assembly automatically disconnect upon contact. In the embodiment of FIG. 7 the rods 84 are easily varied in height to accommodate differing positions of swimming board 76. The apparatus is extremely quick to operate. Using it a boat 10 can be raised or launched in less than one minute.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. Apparatus to raise a small boat and outboard motor from a position in the water to a storage position against a mother vessel with the outboard motor substantially vertical while in the storage position, the apparatus comprising:

a hinge mount adapted to be received on said small boat;

a unitary mount for the outboard motor hinged to said hinge mount;

releasable means to lock the unitary mount on the small boat to prevent hinging of the mount;

a hook on the unitary mount remote from the hinge;

lifting means on the mother vessel having an eye able to attach to said hook on said unitary mount;

at least one rod extending outwardly from said mother vessel;

at least one bracket on said small boat having a recess to receive said rod;

said at least one rod and said at least one bracket being able to engage by bringing the small boat to the mother vessel to allow the rod to contact the bracket;

said at least one rod and said at least one bracket being adapted to form a hinge about which the small boat can be pivoted during lifting by the lifting means.

2. Apparatus as claimed in claim 1 in which the hinge mount comprises a first U-section bracket attached to the small boat;

an upstanding portion on the first bracket to receive a hinge pin; and the unitary mount comprising a second U-section bracket to fit over the first U-section bracket and to be attached to said hinge pin.

3. Apparatus as claimed in claim 2 in which the releasable means to lock the unitary mount comprises a stud received on said first bracket;

a recess on said second bracket to fit over said stud;

locking means received on said stud to attach the first and second brackets together.

4. Apparatus as claimed in claim 1 in which the lifting means comprises a hydraulic cylinder able to move an arm.

5. Apparatus as claimed in claim 1 in which the lifting means comprises a winch.

6. Apparatus as claimed in claim 5 in which the winch is manually operated through a gear system.

7. Apparatus as claimed in claim 1 in which the rods are mounted on brackets that include lockable joints to permit variation of the height of the rods.

8. Apparatus as claimed in claim 1, in which there are a pair of rods and a pair of brackets.

9. Apparatus to raise a small boat and outboard motor from a position in the water to a storage position against the mother vessel with the outboard motor substantially vertical while in a storage position, the apparatus comprising:

a first U-section bracket to be mounted on the small boat;

an upstanding portion on the first bracket to receive a hinge pin;

a second U-section bracket to fit over the first U-section bracket to be attached to said hinge pin, said second U-section bracket being adapted to receive said outboard motor;

a hook on the second U-section bracket remote from the hinge pin;

a winch on the mother vessel comprising a gear box with a handle to rotate said gear box;

a cable extending from, and retractable into, said gear box by rotation of said handle;

an eye on a distal end of the cable to engage said hook;

a pair of rods extending outwardly from said mother vessel;

a pair of housings on the small boat having arcuate recesses to engage said rods, said rods and recesses being engageable on contact;

whereby a small boat may be raised to a storage position on the mother vessel by bringing the small boat adjacent said pair of rods on the mother vessel to engage said rods with said housings by contact, engaging the hook and the eye, rotating the handle to raise said small boat, the second U-section bracket pivoting relative to the first U-section bracket about the hinge pin to allow storage of the outboard motor in a substantially vertical position.

* * * * *